United States Patent [19]

Juillard et al.

[11] 4,046,170

[45] Sept. 6, 1977

[54] LOOMS

[75] Inventors: Yves Juillard; Victor Riner, both of Mulhouse, France

[73] Assignee: Societe Alsacienne de Constructions Mecaniques de Mulhouse, Mulhouse Cedex, France

[21] Appl. No.: 693,185

[22] Filed: June 7, 1976

[30] Foreign Application Priority Data

June 11, 1975 France ..... 75.18199

[51] Int. Cl.[2] ..... D03D 39/16

[52] U.S. Cl. ..... 139/20

[58] Field of Search ..... 139/1, 11, 20–23, 139/35, 55, 115

[56] References Cited

U.S. PATENT DOCUMENTS

| | | | |
|---|---|---|---|
| 1,042,339 | 10/1912 | Gratreau | 139/20 |
| 1,272,532 | 7/1918 | Robinson et al. | 139/20 |

*Primary Examiner*—Henry S. Jaudon
*Attorney, Agent, or Firm*—Cantor & Singer

[57] ABSTRACT

In a loom comprising a shedding harness with heald frames for forming two superposed sheds in incoming warp, weft inserters for traversing weft through said sheds, a reed for heating up the weft whereby to form upper and lower fabric, and a breast beam having upper and lower edges over which said upper and lower fabrics are taken off, respectively, there is provided a rectilinear elongate transverse member which may be a rigid rod or a tight thread and is supported through its two ends, for example by fixture thereof to two supports integral with the loom frame, across the space included, on the one hand between the two sheds and, on the other hand between the leading heald frame of the shedding harness and the location of the reed in the back position.

7 Claims, 2 Drawing Figures

LOOMS

This invention relates to looms for weaving with two superposed sheds and, more particularly to an improvement calculated to improve the shed formations.

In looms for weaving with a single shed, the shuttles or weft inserters rest on the bottom warp sheet, the plane of which is generally defined by a floor of wood or plastics material, possibly covered with plush or velvet; possible rebounds of the shuttles or weft inserters are thus avoided. In looms for weaving with two superposed sheds, it is not customary to provide means for supporting the bottom warp sheet of the upper shed, since a floor fixed to the reed would very much get in the way in the event of a broken warp thread having to be repaired in the bottom shed; moreover, that would much complicate the manufacture of reeds which has nowadays become quite standard. Nevertheless, the fact remains that the bottom warp sheet of the upper shed, which serves as support surface for the shuttle or the weft inserter is then positioned, until now, only by the breast beam and by the corresponding heald eyes in the lowered position. Now, this contact surface is rather badly defined as it is only the actual tension of the warp threads which causes it to take up its lie. Moreover, the distance between the breast beam and the eyes of the heald frames is relatively large so that the area of this bottom warp sheet of the upper shed, over which the weft inserters or shuttles glide, is elastically deformable in the vertical direction with an amplitude incompatible with proper working at high speed. This shortcoming is, besides, augmented by the fact that it is difficult to align the eyes of the various heald frames of the harness accurately, so that the contact surface thus formed is not plane, nor even uniform.

The object of the invention is to improve looms for weaving with two superposed sheds, with a view to avoiding the aforesaid disadvantages of conventional looms.

To this end there is provided, in accordance with the invention a rectilinear elongate transverse member supported, through its two ends, in the space included, on the one hand, between the two sheds and, on the other hand, between the leading movable heald frame of the shedding harness and the location of the reed in the back position.

Thanks to the presence of this rectilinear elongate transverse member, not only is there a reduction in the length of the taut part of the warp threads over which the shuttles or weft inserters are directed, but above all the warp shed is given a perfectly uniform and plane lie, whatever might be the positional deviations in the vertical direction of the eyes of the heald frames in relation to one another.

The invention will be better understood on reading the description which is about to follow and on examination of the annexed drawings which show, by way of non-limiting example, the relevant part of an improved double shed loom according to the invention.

Figure 1:
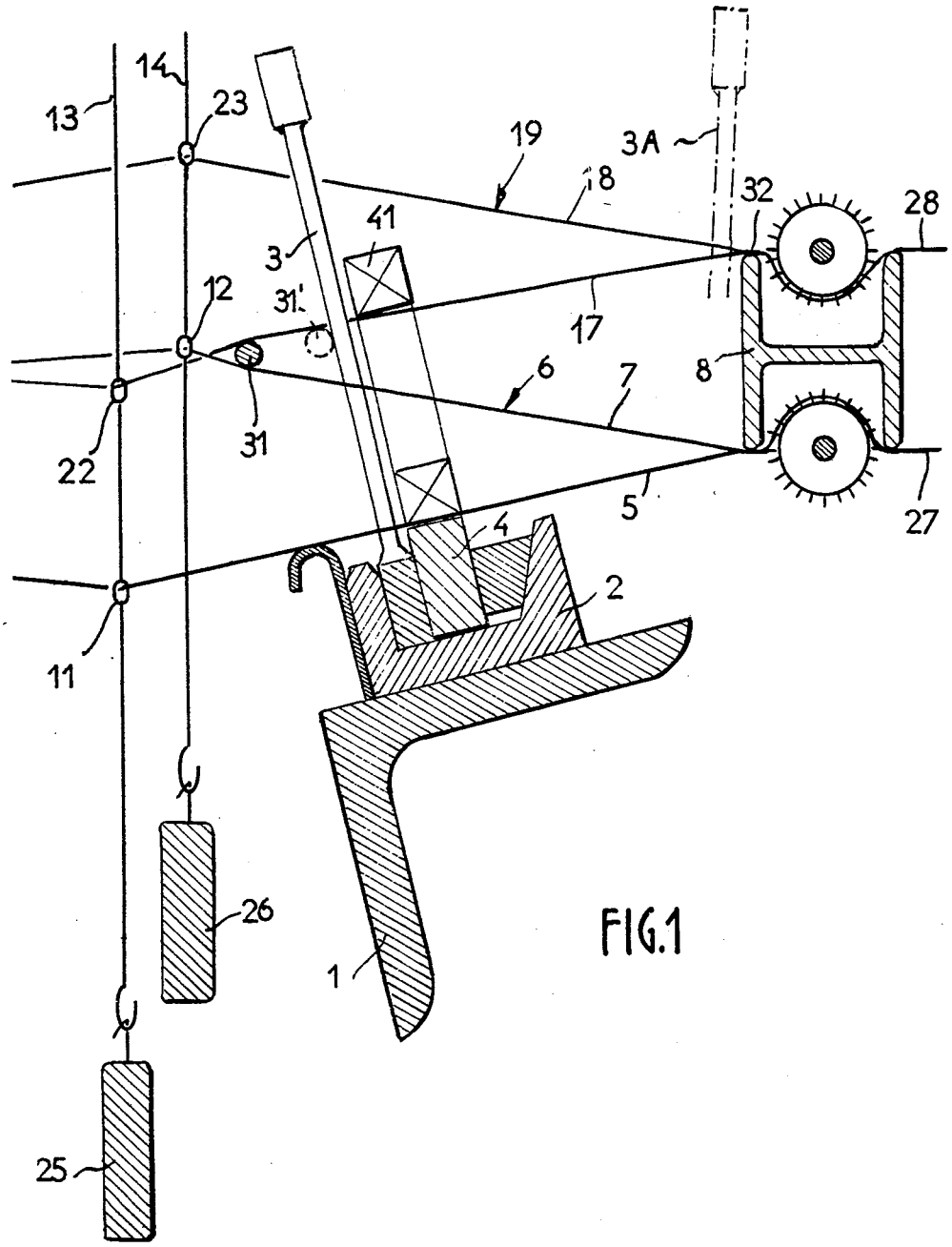
FIG. 1 is a vertical longitudinal section of said part of the loom.
Figure 2:
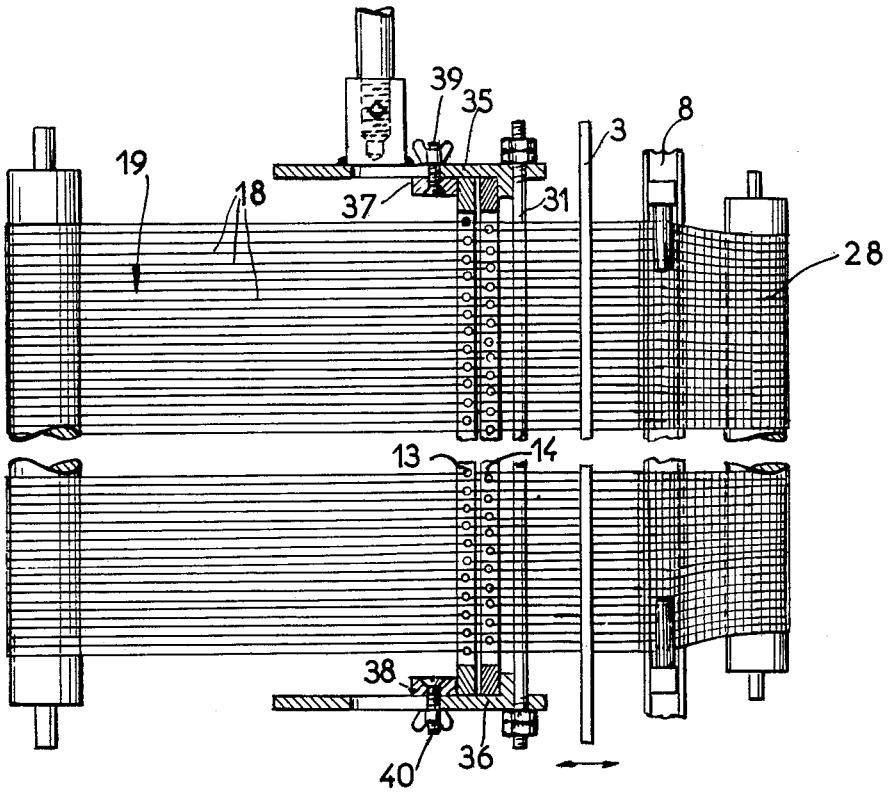
FIG. 2 is a corresponding plan view, on a smaller scale.

In the loom for weaving with two sheds shown only in part in FIGS. 1 and 2, there is the upper part of the slay 1 which supports a cap 2 in which are mounted the reed 3 and a floor 4 for supporting the bottom warp sheet 5 of the lower shed 6.

The bottom sheet 5 and the upper sheet 7 of the lower shed 6 are positioned by the lower edge of the breast beam 8 and by the eyes, such as 11 and 12, of the heald frames 13 and 14 of the shedding harness. The bottom sheet 17 and the upper sheet 18 of the upper shed 19 are positioned by the upper edge of the breast beam 8 and by the eyes, such as 22 and 23, of the heald frames 13 and 14. There are indicated at 25 and 26 tension weights of the heald frames 13 and 14, and at 27 and 28 the two fabrics made on the loom.

In accordance with the invention, a rectilinear elongate transverse member 31 is supported, through its two ends, in the space included, on the one hand, between the two sheds 6 and 19 and, on the other hand, between the leading movable heald frame 14 of the shedding harness and the location of the reed 3 in the back position. There is indicated by way of guidance in phantom in FIG. 1, the forward position 3A of the reed at the instant the weft thread is beaten up against the fell 32. In the example, the member 31 is constituted by a metal rod made fast and kept taut by two brackets 35 and 36 (FIG. 2) which are mounted to be horizontally slidable on components 37 and 38 integral with the loom frame and which can be fixed in position by screw and nut devices 39 and 40.

Owing to the presence of the elongate and rectilinear transverse member 31, the positions of all of the warp threads of the bottom sheet 17 of the upper shed 19 are perfectly defined by the plane fixed, on the one hand, by the upper edge of the breast beam 8 and, on the other hand, by the upper face of said member 31. Thus the shuttle or the weft inserter 41, which is displaced in the upper shed 19, can slide upon a perfectly plane support surface made up by said warp threads. A more or less imprecise and irregular setting of the eyes 22 and 23 of the heald frames can no longer have any consequential effects on the smoothness of the slideway provided by the bottom warp sheet 17 for the upper shuttle or weft inserter 41.

The setting of the lower position of the eyes involved on the upper shedding does not therefore have to be carried out with precision, it being ordinarily sufficient that this lower position is always a little below the level of the fixed rod 31.

The rectilinear elongate transverse member 31 could be constituted otherwise than by a metal rod and, for example, by a single tight thread.

For the manufacture of fine fabrics, given that the warp threads cannot be subjected to strong tension, it may be desirable to set the rectilinear elongate member as indicated at 31′ in FIG. 1, that is practically against the reed 3 in the back position, in order to support the bottom warp sheet 17 of the upper shed properly as closely as possible to the path of the weft inserters 41.

On the contrary, when working with strong warp threads, it is preferable to locate the rectilinear elongate member as indicated at 31, that is to say quite close to the leading heald frame 14, in order to facilitate the repair of the warp threads of the lower shed.

Of course, the invention is not restricted to the embodiment described and shown, and modifications may be introduced therein without thereby departing from the scope of the invention.

We claim:

1. A loom comprising a shedding harness with heald frames for forming two superposed sheds in incoming warp, weft inserters for traversing weft through said sheds, a reed for beating up the weft whereby to form upper and lower fabrics, a breast beam having upper and lower edges over which said upper and lower fabrics are taken off, respectively, and a rectilinear elongate transverse member stationarily supported, through its two ends, across the space included, on the one hand between the two sheds and, on the other hand, between the heald frame nearest said reed and the location of the reed in the back position.

2. A loom as set forth in claim 1, further comprising a frame, two supports secured to said frame, and wherein said rectilinear elongate transverse member is fixed through its two ends, respectively, to said two supports.

3. A loom for the weaving of coarse fabrics as set forth in claim 2, wherein said rectilinear elongate transverse member is located proximate said nearest heald frame.

4. A loom for the weaving of fine fabrics as set forth in claim 2, wherein said rectilinear elongate transverse member is located proximate the location of the reed in the back position.

5. A loom as set forth in claim 1, in which said rectilinear elongate transverse member is constituted by a rigid rod.

6. A loom as set forth in claim 1, in which said rectilinear elongate transverse member is constituted by a taut thread.

7. A loom comprising a shedding harness with heald frames for forming two superposed sheds in incoming warp, weft inserters for tranversing weft through said sheds, a reed for beating up the weft whereby to form upper and lower fabrics, a breast beam having upper and lower edges over which said upper and lower fabrics are taken off, respectively, a rectilinear elongate transverse member supported, through its two ends, across the space included, on the one hand between the two sheds and, on the other hand, between the leading heald frame of the shedding harness and the location of the reed in the back position, and means for adjusting the placement of the transverse member.

* * * * *